US010196761B2

(12) United States Patent
Raisich et al.

(10) Patent No.: US 10,196,761 B2
(45) Date of Patent: Feb. 5, 2019

(54) METHOD FOR OPERATING A SPINDLE OF A TWO-FOR-ONE TWISTING OR CABLING MACHINE

(71) Applicant: Saurer Germany GmbH & Co. KG, Remscheid (DE)

(72) Inventors: Andrej Raisich, Kempten (DE); Jürgen Schnitzler, Viersen (DE)

(73) Assignee: Saurer Germany GmbH & Co. KG, Remscheid (DE)

( * ) Notice: Subject to any disclaimer, the term of this patent is extended or adjusted under 35 U.S.C. 154(b) by 106 days.

(21) Appl. No.: 15/345,699

(22) Filed: Nov. 8, 2016

(65) Prior Publication Data

US 2017/0130369 A1 May 11, 2017

(30) Foreign Application Priority Data

Nov. 9, 2015 (DE) ..... 10 2015 014 383

(51) Int. Cl.

| | |
|---|---|
| ***D01H 7/86*** | (2006.01) |
| ***D01H 1/10*** | (2006.01) |
| ***D01H 1/16*** | (2006.01) |
| ***D01H 1/244*** | (2006.01) |

(Continued)

(52) U.S. Cl.

CPC ..... *D01H 7/86* (2013.01); *D01H 1/103* (2013.01); *D01H 1/106* (2013.01); *D01H 1/166* (2013.01); *D01H 1/244* (2013.01); *D01H 7/868* (2013.01); *D01H 9/18* (2013.01); *D02G 3/285* (2013.01); *D07B 2207/4009* (2013.01)

(58) Field of Classification Search

CPC ..... D01H 7/86; D01H 7/868; D01H 7/864; D01H 1/103; D01H 1/106; D01H 1/166; D01H 1/244; D01H 9/18; D02G 3/285

USPC ..... 57/58.49, 354–357, 58.52

See application file for complete search history.

(56) References Cited

U.S. PATENT DOCUMENTS 2,729,932 A * 1/1956 Vibber ..... D01H 1/006 57/58.55

2,870,596 A * 1/1959 Vibber ..... D01H 13/104 57/356

(Continued)

FOREIGN PATENT DOCUMENTS

DE 1 813 801 A1 7/1970

DE 37 39 175 A1 6/1988

(Continued)

OTHER PUBLICATIONS

European Search Report dated Apr. 4, 2017, for corresponding European Patent Application No. 16196199.0, all enclosed pages cited.

*Primary Examiner* — Shaun R Hurley

*Assistant Examiner* — Bao-Thieu L Nguyen

(74) *Attorney, Agent, or Firm* — Nelson Mullins Riley & Scarborough LLP

(57) ABSTRACT

A method for operating a spindle (2) of a two-for-one twisting or cabling machine which has an adjustable balloon-yarn-guide-eye (9), wherein for the operation of the spindle (2) under production conditions, the balloon-yarn-guide-eye (9) is adjusted, on the basis of a measured value (i) correlating with the energy consumption of the spindle drive (3), to a first operating position ($AP_1$), in which a position-dependent minimum of the energy consumption of the spindle drive (3) is reached.

9 Claims, 5 Drawing Sheets

(51) Int. Cl.
*D01H 9/18* (2006.01)
*D02G 3/28* (2006.01)

(56) References Cited

U.S. PATENT DOCUMENTS 2,871,648 A * 2/1959 Vibber ..... D01H 13/108 57/58.36
RE24,840 E * 6/1960 Vibber ..... D01H 1/101 57/58.55
3,153,893 A * 10/1964 Vibber ..... D02G 3/285 57/58.3
3,192,698 A * 7/1965 Vibber ..... D01H 13/104 57/58.55
3,286,450 A * 11/1966 Vibber ..... D02G 3/285 57/58.3
3,336,740 A * 8/1967 Vibber ..... D02G 3/285 57/58.36
RE26,734 E * 12/1969 Vibber ..... D02G 3/285 57/58.3
4,779,409 A * 10/1988 Marchiori ..... D01H 1/06 57/352
4,848,075 A * 7/1989 Frentzel-Beyme .... B65H 57/06 57/264
4,951,456 A * 8/1990 Lucca ..... D01H 1/06 57/115
5,329,755 A * 7/1994 Frentzel-Beyme .... D01H 1/425 57/354
5,551,223 A * 9/1996 Nickolay ..... D01H 13/32 57/1 R
6,332,312 B1 * 12/2001 Loscher ..... D01H 1/025 57/354
8,256,199 B2 * 9/2012 Schlagenhaft ..... D01H 1/10 57/264
2016/0319468 A1 * 11/2016 Hiepp ..... D01H 7/866
2017/0130368 A1 * 5/2017 Raisich ..... D01H 1/103

FOREIGN PATENT DOCUMENTS

DE 39 16 969 A1 11/1989
DE 44 02 582 A1 8/1995
DE 101 51 167 A1 4/2003
DE 10 2008 033 849 A1 1/2010
EP 1 071 837 B1 9/2002
EP 2 260 132 B1 1/2014

* cited by examiner

METHOD FOR OPERATING A SPINDLE OF A TWO-FOR-ONE TWISTING OR CABLING MACHINE

CROSS-REFERENCE TO RELATED APPLICATIONS

This application claims priority from German National Patent Application No. DE 10 2015 014 383.2, filed Nov. 9, 2015, entitled "Verfahren zum Betreiben einer Spindel einer Doppeldrahtzwirn-oder Kabliermaschine", the entire contents of which are incorporated herein by reference.

FIELD OF THE INVENTION

The present invention relates to a method for operating a spindle of a two-for-one twisting or cabling machine which comprises an adjustable balloon-yarn-guide-eye.

BACKGROUND OF THE INVENTION

Since a single yarn often cannot satisfy the requirements which are placed on it with regard to its strength and/or its uniformity during further processing or in the finished product, it is conventional in the textile industry for at least two yarns to be twisted together, for example, by means of a two-for-one twisting or cabling machine, wherein, however, in principle, the winding up of individual yarns is also possible in the two-for-one twisting method.

The known two-for-one twisting or cabling machines, which have been described in detail in numerous patent specifications, each comprise a plurality of identical workstations, wherein in each case, in the region of each workstation, at least one running yarn circulates around a yarn-twisting or cabling spindle in the form of a yarn balloon before it is wound by means of a spooling and winding device to form a take-up bobbin.

In the case of two-for-one twisting, for example, two yarns are connected to one another with a S or Z twist, wherein both yarns each receive an additional twist. With a workstation which operates according to the two-for-one twisting method, this means that a single or multiply folded yarn is often withdrawn upwards from a feed bobbin arranged in the protective pot of the spindle and introduced into the upper end of the hollow bobbin axle of the yarn-twisting spindle via a controllable yarn-supply unit arranged, for example, on the bobbin axle of the yarn-twisting spindle.

The folded or single yarn arrives at a rotatably mounted, driveable yarn-twist-providing element arranged below the protective pot and leaves the yarn-twist-providing element via a radial opening. The, for example, folded yarn is then guided towards a stationary balloon-yarn-guide-eye arranged above the protective pot of the spindle and accordingly forms a yarn balloon rotating around the protective pot here because of the rotation of the yarn-twist-providing element between the yarn-twist-providing element and the balloon-yarn-guide-eye arranged above the protective pot, the size of which can be adjusted by the yarn-supply unit.

Furthermore, in the case of the workstations which operate according to the two-for-one twisting method, there are various feed types with regard to the manner in which the yarns are supplied to the yarn-twisting spindle. For example, the feed yarns can originate from a feed bobbin, which is mounted in a protective pot of the yarn-twisting spindle and on which a folded supply yarn is wound, or from two feed bobbins arranged one above the other in the protective pot of the yarn-twisting spindle, from each of which a feed yarn is unwound.

In the case of the cabling method, it is known that a second yarn is wound around a first feed yarn, wherein the rotation of the single yarn remains substantially unchanged. This means that in the case of a workstation which operates according to the cabling method, two separately arranged feed bobbins are often used.

In this context, a first feed bobbin is conventionally arranged in a protective pot of the cabling spindle, while the second feed bobbin is often kept ready in a bobbin rack which is positioned above the workstation. From this feed bobbin stored in the bobbin rack, a so-called outer yarn is withdrawn, for example, by a yarn-supply unit, and introduced from below into the hollow bobbin axle of a driveable yarn-twist-providing element mounted in a rotatable manner, which is constituted, for example, as a storage disk.

The running outer yarn leaves the storage disk via a radial opening and is then guided, for example, via a so-called yarn discharge plate arranged on the storage disk, to a stationary balloon-yarn-guide-eye arranged above the protective pot, where it winds around the feed yarn of the first feed bobbin, or is cabled, as this is designated by specialists in the field.

Because of the rotation of the storage disk between the yarn discharge plate and the balloon-yarn-guide-eye arranged above the protective pot, the outer yarn forms a yarn balloon rotating around the protective pot, the size of which can be adjusted during the cabling process by the yarn-supply unit arranged in the region of the yarn pathway of the outer yarn.

After passing the stationary balloon-yarn-guide-eye, the twisted or cabled yarn is wound by a spooling and winding device onto a take-up bobbin.

In the case of the workstations of the known two-for-one twisting or cabling machines, in which the height of the circulating yarn balloon is limited in each case by a balloon-yarn-guide or respectively a balloon-yarn-guide-eye, it is often not possible or respectively extremely difficult to vary the height of the yarn balloon during the operation of the workstation.

Since there is a risk of a yarn break occurring, especially in the case of friction-sensitive yarn materials, such as polypropylene, polyester or polyacrylic, if the yarn balloon comes into contact with the stationary protective pot of the spindle during the yarn twisting or cabling process, it was initially conventional with such two-for-one twisting or cabling machines to adjust the diameter of the yarn balloon in such a manner that it is disposed safely above the diameter of the stationary protective pot.

However, since large yarn balloons are known to lead to relatively large ventilation losses and therefore to an increased energy requirement of the workstations of the two-for-one twisting or cabling machines, various attempts have already been made in the past, especially in conjunction with less friction-sensitive yarn materials, such as cotton, to reduce or respectively to limit the diameter of the yarn balloons.

In the case of a two-for-one twisting or cabling machine as described, for example in German Patent Publication DE-OS 1 813 801, the feed bobbin is arranged, for example, not protected in a stationary protective pot, but is disposed openly on a component of the two-for-one yarn-twisting spindle constituted as a bobbin carrier.

In order to avoid contact between the circulating yarn balloon supported externally on a cylindrical balloon limiter and the feed bobbin, a cylindrical yarn guide, arranged between the balloon limiter and the feed bobbin, which surrounds the feed bobbin at the height of the upper edge of the balloon limiter, is also provided in this known two-for-one yarn-twisting spindle.

However, the disadvantage with these known two-for-one yarn-twisting spindles is the relatively long physical contact of the circulating yarn balloon with the stationary balloon limiter.

Since the stresses acting on the yarn as a result of such stationary balloon limiters are relatively high, such two-for-one yarn-twisting spindles can be used only for relatively insensitive yarns.

It has therefore already been suggested that the size, that is, the diameter, of the yarn balloon can be influenced by implementing controlling or regulating interventions with regard to the yarn tension of the yarn forming the yarn balloon in the workstations of two-for-one twisting or cabling machines.

Such two-for-one twisting or cabling machines as described, for example, in German Patent Publication DE 10 2008 033 849 A1, conventionally comprise a plurality of generally identically constituted workstations arranged side-by-side.

The workstations of these known two-for-one twisting or cabling machines each comprise a stationary protective pot for the accommodation of at least one feed bobbin, a rotatably mounted yarn-twisting or cabling spindle and a unit for influencing the yarn tension, for example, a yarn-supply unit.

The workstations of these known textile machines in each case further comprise a balloon-yarn-guide arranged in a stationary manner.

Furthermore, European Patent Publication EP 2 260 132 B1 describes a twisting or cabling machine in which the rate of production of the workstations is increased through a corresponding positioning of the yarn balloon guide, but in which the quality of the yarn is not supposed to be impaired.

For this purpose, the workstations of these known textile machines are each supposed to be fitted with a vertically adjustable yarn balloon guide. However, no indications can be derived from European Patent Publication EP 2 260 132 B1 regarding the constructive constitution of the vertically adjustable yarn balloon guide. This literature reference also contains no indications of how or where the yarn balloon guides should advantageously be positioned.

However, for a considerable time, various textile devices have been known in the textile-machine industry, which allow the height of the yarn balloon to be influenced.

For example, in German Patent Publication DE 37 39 175 A1, a bobbin rack is described, in which the running behaviour of the feed bobbins is optimised in that the distance between the relevant feed bobbin and an associated balloon-yarn-guide is varied constantly during operation, in each case, dependent upon the weight of the feed bobbin.

This means that, with this known bobbin rack, either the feed bobbins or the balloon-yarn-guide-eyes are mounted in a movable manner.

Movably mounted balloon-yarn-guides or more specifically balloon-yarn-guide-eyes have also been known for a considerable time in the context of ring spinning machines.

For example, German Patent Publication DE 44 02 582 A1 describes a ring spinning machine of which the balloon-yarn-guides are mounted in a height adjustable manner, as is conventional with such textile machines. This means that the ring spinning machine comprises several machine rails arranged, in each case, one above the other on both of its longitudinal machine sides, wherein, as known, further machine rails mounted in a vertically movable manner are installed above a stationary spindle rail. In this context, the balloon-yarn-guides of the numerous workstations of the ring spinning machine are arranged on the uppermost of these machine rails, mounted in a vertically movable manner.

With such an arrangement, all of the balloon-yarn-guides on one side of the machine are displaced together during the spinning operation; a separate control of the balloon-yarn-guide of an individual workstation is not possible.

A ring spinning machine with a comparable arrangement of the balloon-yarn-guide is also known from European Patent Publication EP 1 071 837 B1. Furthermore, with this known ring spinning machine, the balloon-yarn-guides of the numerous workstations are each arranged in a tiltable manner on the associated vertically displaceable machine rail.

With such a tiltable arrangement of the balloon-yarn-guides, the access to the ring spinning spindles is supposed to be improved, and accordingly, the automation of the bobbin changing process of the ring spinning machine should be considerably improved.

SUMMARY OF THE INVENTION

Starting from the prior art described above, the invention is based upon the object of developing a method, which allows a safe and energetically economical operation of a spindle of a two-for-one twisting or cabling machine fitted with an adjustable balloon-yarn-guide-eye.

This object is addressed according to the invention in that, for the operation of the spindles under production conditions, the balloon-yarn-guide-eye is adjusted, on the basis of a measured value correlating with the energy consumption of the spindle drive, to a first operating position, in which a position-dependent minimum of the energy consumption of the spindle drive is achieved.

Advantageous embodiments of the method according to the invention are more fully described hereinafter.

The method according to the invention has the particular advantage that during the operation of the workstation, it is ensured at all times that the balloon-yarn-guide-eye is always positioned in an advantageous operating position. That is, dependent upon a measured value, which is provided by a unit which monitors the energy consumption of the spindle drive, the balloon-yarn-guide-eye is immediately displaced into a first operating position, in which the spindle drive comprises a minimum of energy consumption, and fine-tuned.

In a first advantageous embodiment of the method according to the invention, it is therefore provided that the respective first operating position of the balloon-yarn-guide-eye to be approached dependent upon yarn-twisting parameters is determined in advance and can be called up for the yarn-twisting batch to be processed in order to control an adjustment drive for the balloon-yarn-guide-eye.

Such an embodiment has, inter alia, the advantage that shortly after the start of a yarn-twisting batch in a workstation, operating conditions can already be created through an optimal positioning of the balloon-yarn-guide-eye in a first operating position, which guarantee a correct, energetically favourable, that is, economical operation of the workstation.

Furthermore, the workstation can be adapted to the new requirements without difficulty, reliably and rapidly for every batch change, that is, the balloon-yarn-guide-eye can be displaced immediately into a first operating position dependent upon the new yarn-twisting parameters and held there with optimum positioning.

A further particularly advantageous embodiment of the method is present if the first operating position of the balloon-yarn-guide-eye to be approached dependent upon yarn-twisting parameters is adjusted via a control circuit and fine-tuned during the operation of the spindle, wherein a measured value correlating with the energy consumption of the spindle drive serves as control value. That is, a control circuit which controls the adjustment drive in such a manner that the latter always displaces the balloon-yarn-guide-eye into an advantageous operating position and holds it there, is connected to an adjustment drive of the balloon-yarn-guide-eye.

Furthermore, the control circuit is connected to a unit which, for example, monitors the energy consumption of the spindle drive and generates a measured value from this. This measured value is then processed by the control circuit in such a manner that the adjustment drive of the balloon-yarn-guide-eye is caused to displace the balloon-yarn-guide-eye into an advantageous operating position.

By preference, the control circuit thus operates in such a manner that measured values which are related to a given event in the relevant workstation, for example, spindle start, yarn break, end of running period or batch change, are always used immediately for a defined control of the adjustment drive of the balloon-yarn-guide-eye and accordingly for an advantageous positioning in a starting position, designated in the following as a resting position or an optimal operating position.

With such a manner of operation of the control circuit, it is therefore ensured at all times during the operation of the workstation that the balloon-yarn-guide-eye is positioned advantageously.

Furthermore, an advantageous embodiment of the method according to the invention is given if the current consumption of the spindle drive or the size of a yarn balloon or the yarn tension of an outer yarn forming the yarn balloon serves as the measured value correlating with the energy consumption of the spindle.

That is, the unit for detecting a measured value is, for example, a measuring device which monitors the energy demand of the spindle drive during the operation of the workstation.

With a measuring device of this kind, the current which is consumed during the operation of the workstation by the spindle drive is detected, and from this, a measured value is generated which allows inferences about the momentary operational condition of the workstation, especially the size of the yarn balloon and accordingly the position of the balloon-yarn-guide-eye. This means that, by measuring the output or respectively the torque of the drive unit of the spindle, the measuring device provides a measured value which is specified by the size of the yarn balloon and used by the control circuit in order to position the balloon-yarn-guide-eye advantageously by means of an associated adjustment drive.

However, the device for detecting a measured value capable of being processed by the control circuit can also be constituted as a sensor device which detects optically the size of a yarn balloon circulating around the spindle during the operation of the workstation. In this context, the sensor device is, for example, constituted as a light barrier, which comprises a light source and a light receiver and which scans the circulating yarn balloon with a light beam.

With such a sensor device, the yarn forming the yarn balloon causes disturbances through shadows across the light beam with every rotation, which are processed by the sensor device to form a measured value and rerouted to the control circuit.

Such light barriers are not only relatively cost favourable, but also comprise a very high sensitivity and fast response, so that the circulating yarn balloon is always scanned rapidly and reliably.

However, a yarn-tension sensor can also be used as the unit for detecting a measured value, which is arranged in the region of the yarn pathway of a twisted or cabled yarn, preferably between the balloon-yarn-guide-eye and a yarn-supply unit disposed upstream of a spooling and winding device.

Such a yarn tension sensor connected to the control circuit is capable of generating from the measured yarn tension a measured value, on the basis of which the control circuit causes the adjustment drive of the balloon-yarn-guide-eye to position the balloon-yarn-guide-eye of the workstation optimally.

In a further advantageous embodiment of the method according to the invention, it is provided that the yarn tension of the outer yarn constituting the yarn balloon is increased by means of a controllable yarn-tension influencing device, constituted as a yarn-supply unit or yarn brake, in such a manner that, for the operation of the spindle, the yarn balloon is reduced to a size at which it still does not yet contact the yarn-twisting pot of a feed bobbin. This means that each of the workstations of the two-for-one twisting or cabling machine is provided with a controllable yarn-tension influencing device, which is preferably constituted as a yarn-supply unit or as a yarn brake.

Both with a yarn-supply unit and also with a yarn brake, the yarn tension of a circulating yarn balloon can be adjusted very precisely, that is, such a controllable yarn-tension influencing device, in conjunction with an advantageous operating position of the balloon-yarn-guide-eye, allows an optimisation of the size and the shape of the circulating yarn balloon at all times, and accordingly, a significant reduction in the energy consumption of the spindle drive of the relevant workstation.

In an advantageous method step, it is further provided that, after the adjustment of the yarn tension by the controllable yarn-tension influencing device, the balloon-yarn-guide-eye is moved back, with further reduction of the energy consumption in the yarn running direction to a further, second operating position, at the overshooting of which the energy consumption of the spindle rises again.

In this manner, it is possible to position the balloon-yarn-guide in an operating position in which the yarn balloon comprises its most advantageous shape, that is, in which the circulating yarn of the yarn balloon comprises the lowest ventilation losses and correspondingly, the energy consumption of the spindle drive is at the minimum.

An advantageous embodiment is further given, if the second operating position of the balloon-yarn-guide-eye is determined in advance and can be called up for the yarn-twisting batch to be processed in order to control an adjustment drive for the balloon-yarn-guide-eye.

With such an embodiment, it is possible to create operating conditions which guarantee a correct, energetically favourable operation of the workstation even after a relatively short time through an optimal positioning of the balloon-yarn-guide-eye.

In an advantageous embodiment, it is further provided that the balloon diameter on a plane which is disposed either in the region of the upper edge with the largest external diameter of the protective pot or in the region of the largest yarn balloon diameter is measured as a measured value correlating with the energy consumption of the spindle drive.

The arrangement, for example, of a light barrier in one of these regions is advantageous, because, not only is there space in these regions for the installation of a light barrier, but also, because a free view of the circulating yarn balloon is always ensured on these planes. That is to say, through the installation of a light barrier on one of these planes, a correct monitoring of the diameter of the circulating yarn balloon is guaranteed at all times.

BRIEF DESCRIPTION OF THE DRAWINGS

Further details of the invention are described in the following with reference to exemplary embodiments illustrated in the drawings, wherein.

DETAILED DESCRIPTION OF THE INVENTION

Figure 1:
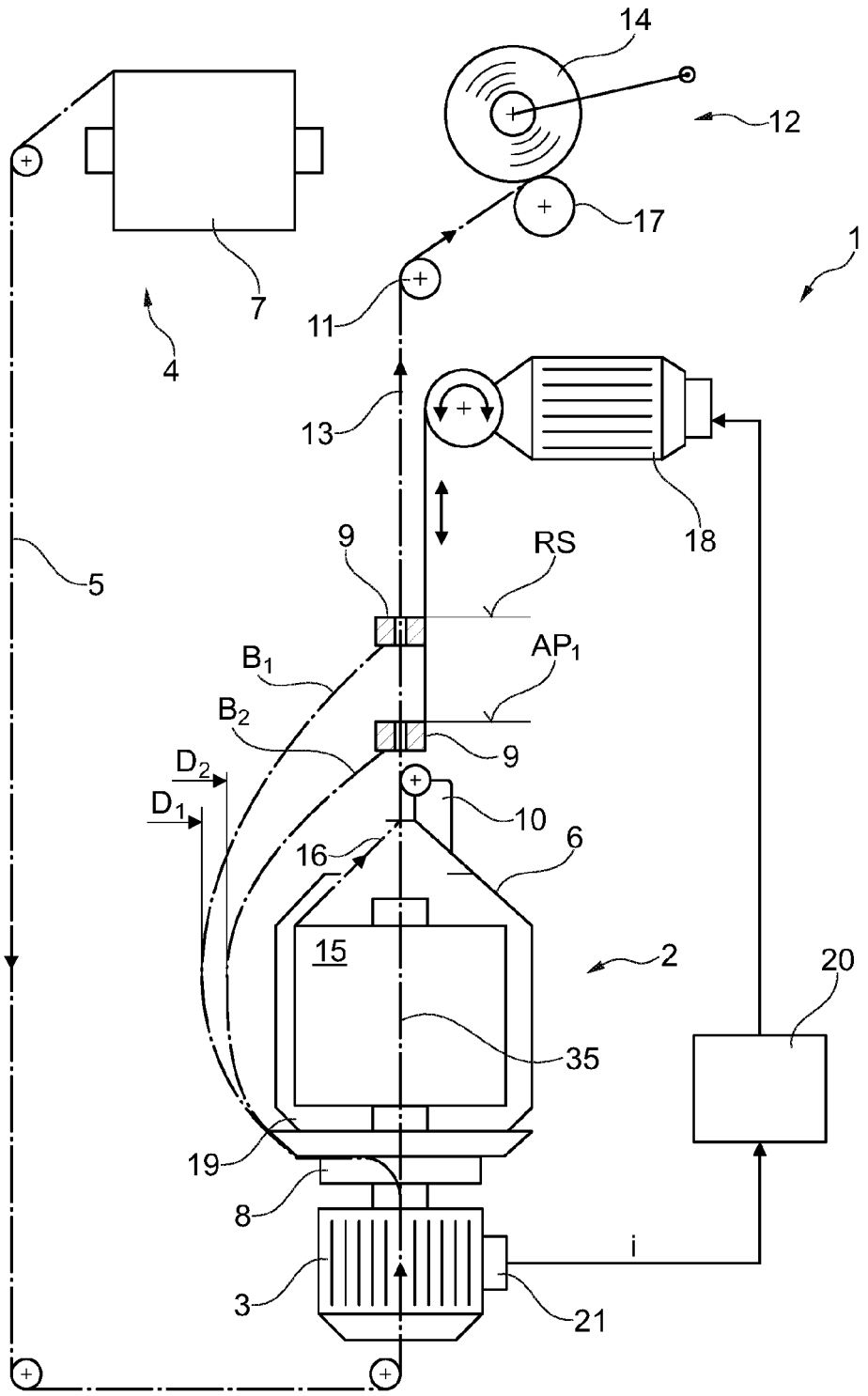
FIG. 1 schematically depicts, in a lateral view, a workstation of a cabling machine, with a balloon-yarn-guide-eye which is height adjustable by means of an adjustment drive, a control circuit connected to the adjustment drive of the balloon-yarn-guide-eye and a device for monitoring the energy consumption of the spindle drive.

FIG. 1 shows a schematic lateral view of a workstation 1 of a two-for-one twisting or cabling machine.

In the exemplary embodiment, the workstation 1 is fitted with a spindle 2 constituted as a cabling spindle.

The workstation 1 comprises a balloon-yarn-guide-eye 9, which is height adjustable by means of an adjustment drive 18 and can be optionally positioned in a starting position designated as resting position RS or a first operating position $AP_1$.

In this context, the adjustment drive 18 is connected to a control circuit 20, which is further connected to a device 21 for generating a measured value i.

Above or behind the workstation 1, a bobbin rack 4 (not illustrated in greater detail) is positioned, which generally serves to accommodate several feed bobbins 7.

From one of these feed bobbins 7, referred to in the following as the first feed bobbin 7, a so-called outer yarn 5 is withdrawn, which, deflected several times in the region of a rotational axis 35 of the cabling spindle 2, is threaded into the hollow rotary axle of the spindle drive 3.

The outer yarn 5 leaves the hollow rotary axle of the spindle drive 3 through a so-called yarn discharge borehole facing radially outwards, arranged somewhat below a protective pot 19 and reaches the external region of a yarn-deflection device 8 which is also mounted in a rotatable manner about the rotational axis 35.

On leaving the yarn-deflection device 8, the running outer yarn 5 is deflected upwards and extends, with the formation of a yarn balloon B, of which the shape and size is specified, inter alia, by the position of the balloon-yarn-guide-eye 9 and which circulates around the protective pot 19, to the balloon-yarn-guide-eye 9, which, at the beginning of the cabling process, is positioned in a resting position RS.

In the region of the balloon-yarn-guide-eye 9, the outer yarn 5 meets an inner yarn 16, which is withdrawn simultaneously overhead from a second feed bobbin 15, which is mounted in the protective pot 19 of the cabling spindle 2.

The protective pot 19, which comprises, for example, a hood 6 with a yarn brake 10, is arranged on the rotatably mounted yarn-deflection device 8 and, in this context, preferably secured against rotation by a magnetic device (not illustrated). The rotatably mounted yarn-deflection device 8 of the cabling spindle 2 is supplied with drive, that is, either a direct drive in the form of a spindle drive 3 is provided, as illustrated in the present exemplary embodiment, or an indirect drive device (per se known, not illustrated) is provided.

The yarns (outer yarn 5 and inner yarn 16) cabled in the region of the balloon-yarn-guide-eye 9, for example, to form a corded yarn 13, arrive, via a yarn-conveying device 11, at a spooling and winding device 12, where they are wound onto a take-up bobbin 14. This means that during the running operational process of the workstation 1, in the region of the balloon-yarn-guide-eye 9, yarns 5 and 16 cabled to form a corded yarn 13 are wound on the spooling and winding device 12 to form a take-up bobbin 14, which is constituted, for example, as a cross-wound bobbin, wherein twisted, cabled or high-twist yarns are designated as corded yarns.

For this purpose, the spooling and winding device 12 provides, inter alia, a drive roller 17, which drives the take-up bobbin 14 during the operating process via friction drive.

As already suggested above, the balloon-yarn-guide-eye 9 is mounted in a vertically displaceable manner and connected to an adjustment drive 18, which, for its part, is connected to a control circuit 20, which is connected to a device for detecting a measured value i.

In the illustrated embodiment, this device is a measuring device 21, which monitors the energy consumption of the spindle drive 3 during the operation of the workstation 1. This means that the measuring device 21 makes available to the control circuit 20 a measured value i, which the control circuit 20 uses for controlling the adjustment drive 18, when the spindle 2 has reached its operational speed and, correspondingly, the energy consumption of the spindle drive 3 has reached a given level.

That is, the adjustment drive 18 is controlled in such a manner that it displaces the balloon-yarn-guide-eye 9 from its resting position RS into a first operating position $AP_1$ in which the yarn balloon B2 comprises a significantly lower height and also a significantly smaller diameter D2 than the yarn balloon B1 with the diameter D1, which is present when the balloon-yarn-guide-eye 9 is positioned in the resting position RS.

The reduction in size of the yarn balloon B achieved through the displacement of the balloon-yarn-guide-eye 9 into the operating position $AP_1$ also immediately leads to a significant reduction of the atmospheric friction to be overcome during the circulation of the yarn balloon by the yarn 5, with the consequence that the energy consumption of the spindle drive 3 of the workstation 1 is significantly reduced.

Figure 2:
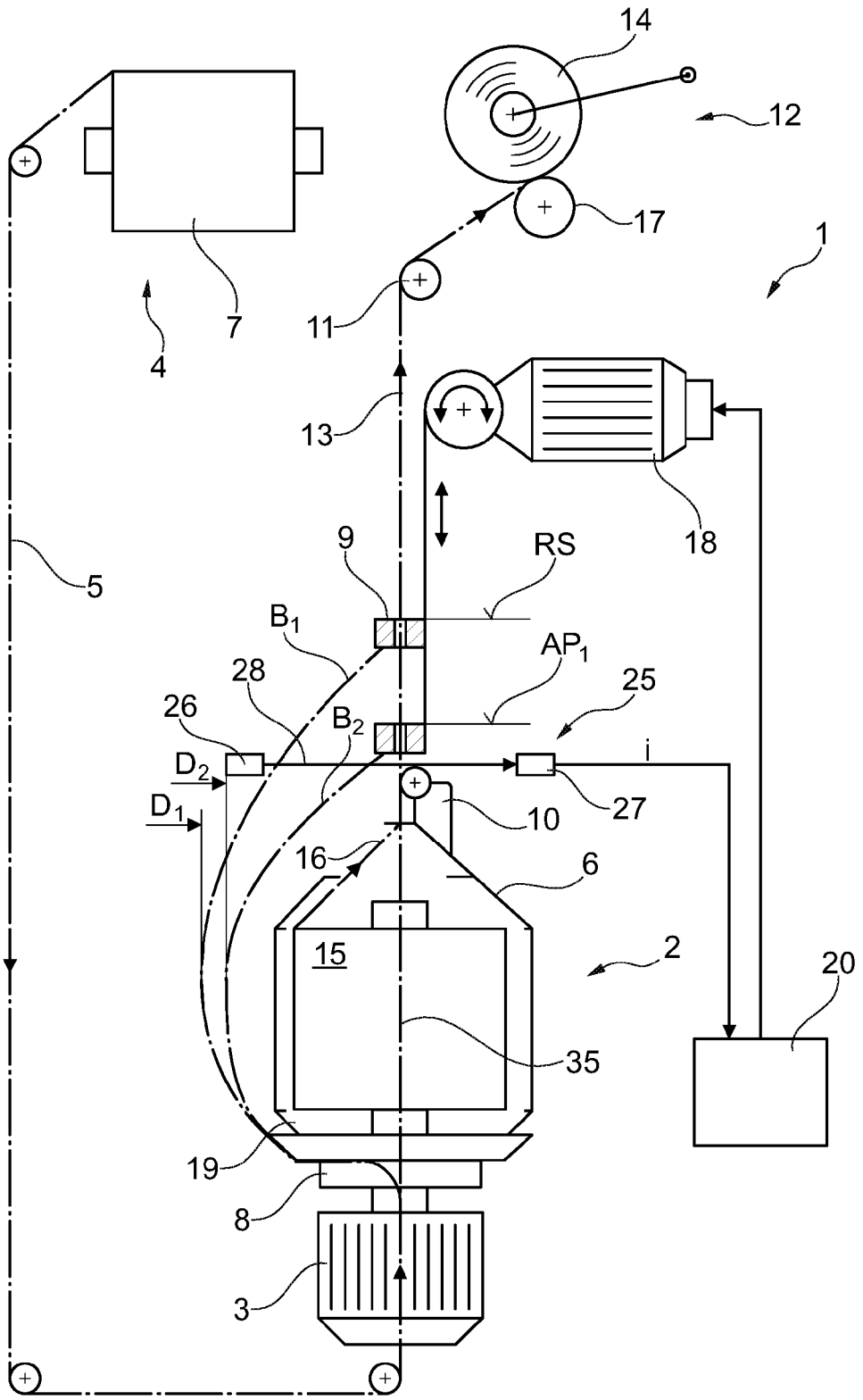
FIG. 2 depicts the workstation as shown in FIG. 1, with a device constituted as a light barrier connected to the control circuit for monitoring the diameter of a yarn balloon circulating around the spindle.
Figure 3:
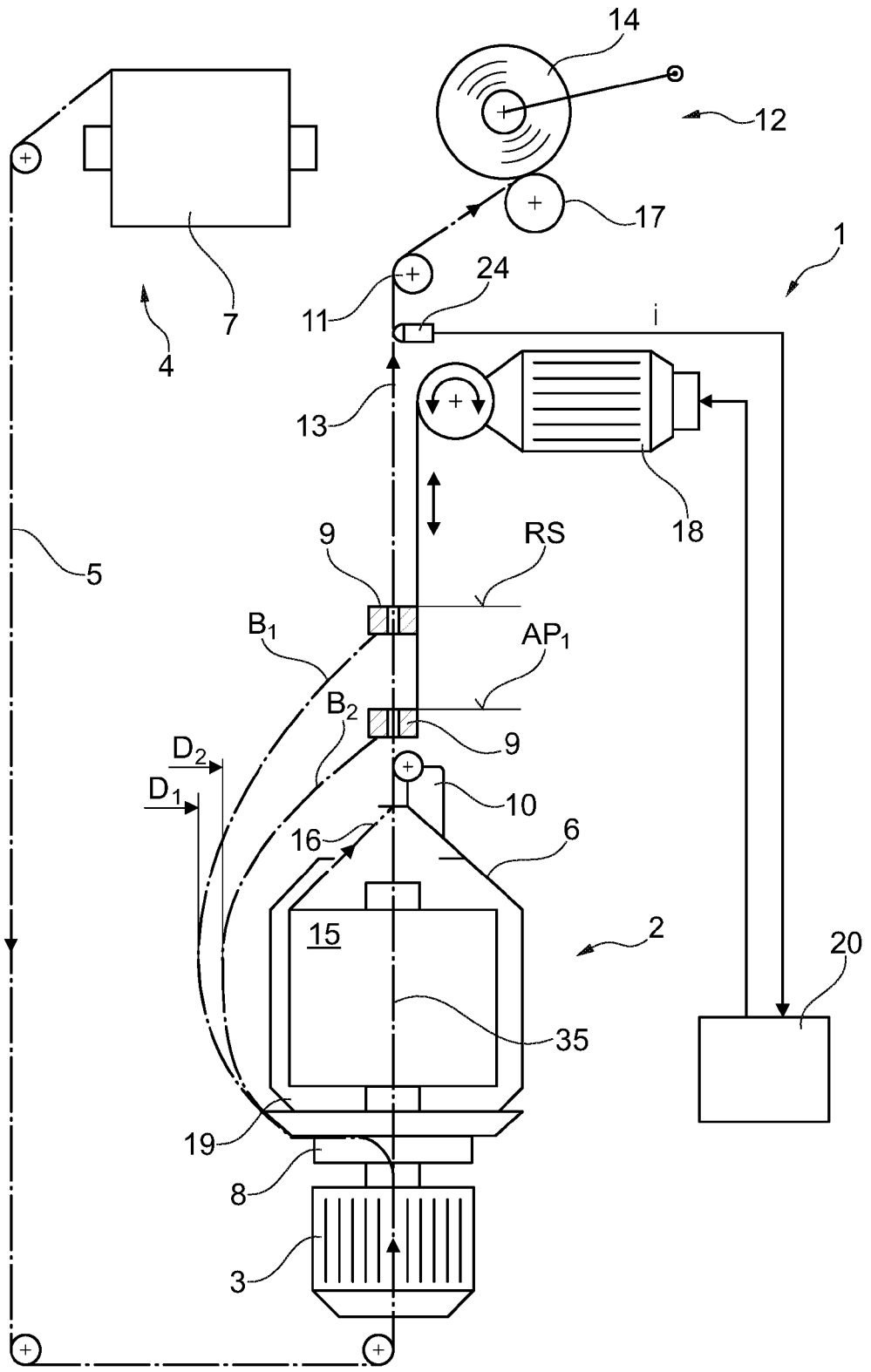
FIG. 3 depicts the workstation according to FIG. 1, with a yarn-tension sensor connected to the control circuit in order to generate a measured value.

The embodiments of a workstation 1 of a two-for-one twisting or cabling machine illustrated in FIGS. 2 and 3 differ from the workstation shown in FIG. 1 only with regard to the constitution of their devices for detecting a measured value i.

In the case of the embodiment according to FIG. 2, the device for detecting a measured value i is a sensor device 25, which is constituted as a light barrier, that is, the sensor device 25 comprises a light source 26 and a light receiver 27.

With such optically operating light barriers, the circulating yarn of the yarn balloon B, in the exemplary embodiment, the outer yarn 5 originating from the first feed bobbin 7, intermittently shades a light beam 28 of the light barrier with every circulation of the yarn balloon B, which, in conjunction with the momentary rotational speed of the spindle 2 allows inferences regarding the size of the yarn balloon B.

That is, with such a sensor device 25 constituted as a light barrier connected to the control circuit 20, the size of the yarn balloon B can be monitored relatively simply and, when a given size of the yarn balloon B is reached, which indicates, for example, the reaching of the operational speed of the spindle drive 3, a measured value i can be communicated to the control circuit 20.

As already explained above in connection with FIG. 1, the control circuit 20 then ensures that the adjustment drive 18 optimises the balloon-yarn-guide-eye 9 with regard to its position, that is, the adjustment drive 18 moves the balloon-yarn guide-eye 9 out of its resting position RS into the operating position $AP_1$ and, if required, fine tunes it.

In the case of the embodiment according to FIG. 3, the device for detecting a measured value i is a yarn-tension sensor 24, which is arranged in the yarn course of a corded yarn 13 between the balloon-yarn-guide-eye 9 and the spooling and winding device 12.

With such a yarn-tension sensor 24, the yarn tension of the corded yarn 13, which is dependent, for example, upon the size of the circulating yarn balloon B1, is monitored. The yarn-tension sensor 24 generates a measured value i when the yarn tension reaches a specified limit value, which allows it to be inferred that the cabling spindle 2 has reached its operational speed.

When it receives such a measured value i, the control circuit 20 then ensures that the adjustment drive 18 moves the balloon-yarn-guide-eye 9 into the first operating position $AP_1$, which leads to a smaller yarn balloon B2 and accordingly to a reduction in the atmospheric friction to be overcome by the yarn balloon, which, in turn, has a positive influence on the energy consumption of the spindle drive 3. That is, by displacing the balloon-yarn-guide-eye 9 from the resting position RS into the first operating position $AP_1$, it is possible significantly to reduce the energy consumption of the spindle drive 3 of the workstation 1.

Figure 4:
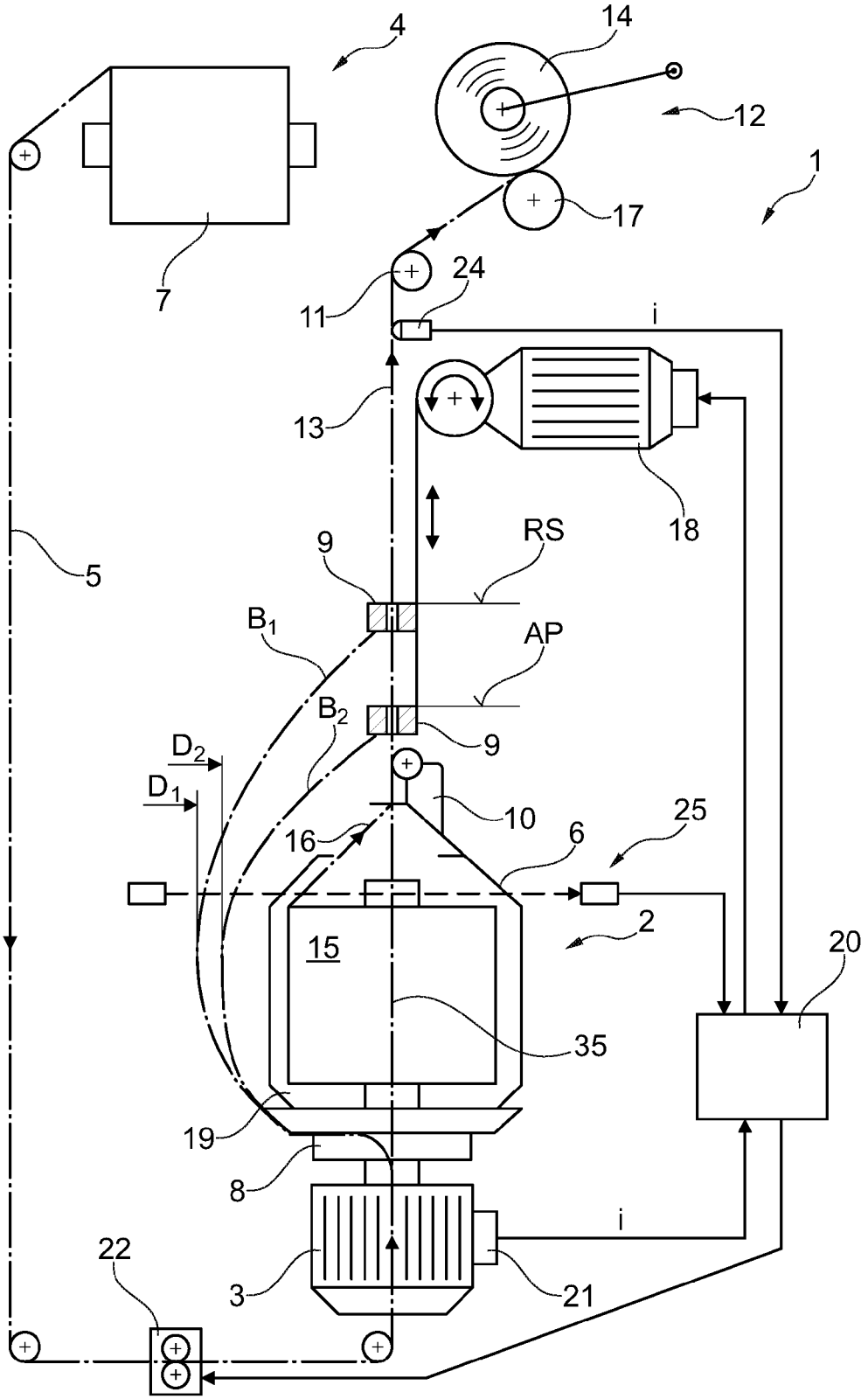
FIG. 4 depicts a further embodiment of a workstation of a cabling machine with a control circuit connected to the adjustment drive of the balloon-yarn-guide-eye, several devices for the provision of a measured value and a yarn-tension influencing device.

FIG. 4 shows a workstation 1 of a cabling machine, which comprises a control circuit 20 connected to the adjustment drive 18 for the balloon-yarn-guide-eye 9, a yarn-tension influencing device 22 connected in the yarn pathway of the outer yarn 5 and, at the same time, several devices for the detection of a measured value i. That is, in the present exemplary embodiment, the workstation 1 comprises a yarn-tension influencing device 22 connected to the control circuit 20 and two devices for detecting a measured value i.

One of these devices for detecting a measured value i is, for example, a measuring device 21, which monitors the energy consumption of the spindle drive 3 during the operation of the workstation 1; the other device for detecting a measured value i is a yarn-tension sensor 24, which scans the corded yarn 13 and is installed, for example, directly below a yarn-conveying device 11.

However, the devices for detecting a measured value i can also be constituted differently; for example, a sensor device 25 constituted as a light barrier which monitors the circulating yarn of a yarn balloon can also be used.

In this context, such a sensor device 25 can be used in addition to the devices 21 and 24 or can also be used instead of one of the devices 21 or 24.

The yarn-tension influencing device 22 connected in the yarn pathway of the outer yarn 5 is, for example, a controllable yarn-supply unit or a controllable yarn brake.

In the case of a workstation 1 which comprises an embodiment as described above with reference to FIG. 4, it is guaranteed that, dependent upon the measured values i of the devices 21 and/or 24 and/or 25, the control circuit 20 not only always reliably ensures that the adjustment drive 18 positions the balloon-yarn-guide-eye 9 advantageously at all times, but also ensures that the yarn-tension influencing device 22 always keeps the yarn tension in the region of the yarn balloon B2 at an optimal value.

Figure 5:
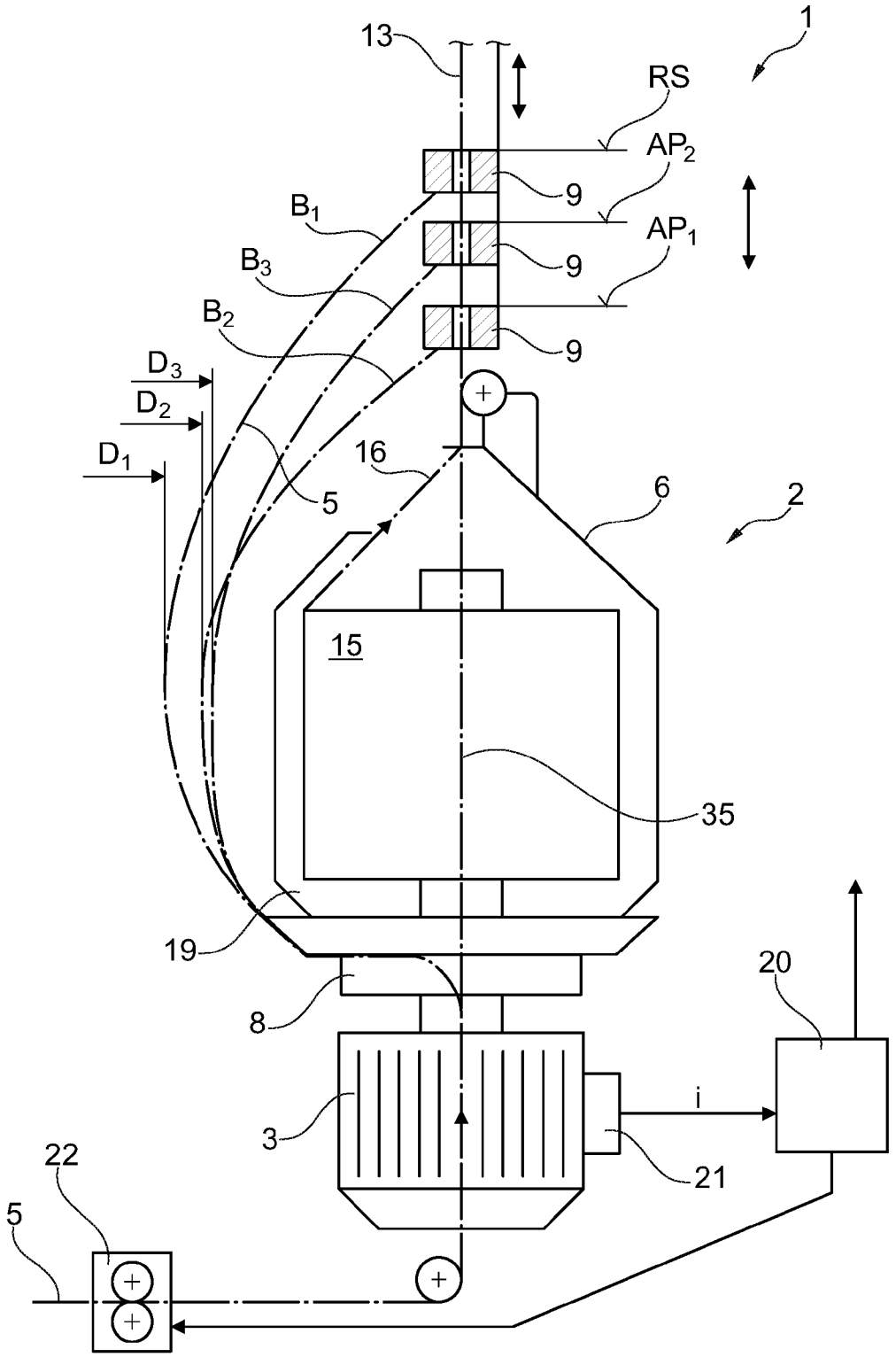
FIG. 5 depicts a workstation of a cabling machine with a control circuit which allows a defined displacement of the balloon-yarn-guide-eye out of a first operating position into a second operating position.

FIG. 5 shows a workstation 1 of a cabling machine in a somewhat larger scale.

As is evident, with this workstation 1, the balloon-yarn-guide-eye 9 can be displaced optionally between a resting position RS, advantageous in the case of interruptions of production, and first or respectively second operating positions $AP_1$, $AP_2$ dependent upon spinning parameters.

In this context, the balloon-yarn-guide-eye 9 can, of course, also be positioned at intervening operating positions resulting in conjunction with transient operating phases. That is, the control circuit 20 is constituted in such a manner that, dependent upon a measured value i provided, for example, by a measuring device 21, the adjustment drive 18 for the balloon-yarn-guide-eye 9 is controlled in such a manner that the balloon-yarn-guide-eye 9 is initially displaced out of its resting position RS into a first operating position $AP_1$ in which the yarn balloon B2 comprises a diameter D2.

In the course of the further operation of the workstation 1, the balloon-yarn-guide-eye 9 is then moved by an adjustment drive 18, to which the control circuit 20 is connected, into a second operating position $AP_2$, which, as shown, leads to a yarn balloon B3 with a smaller diameter D3 and therefore to a reduction in the atmospheric friction to be overcome by the yarn 5 of the yarn balloon.

Subsequently or synchronously, by means of the yarn-tension influencing device 22, which is constituted, for example, as a yarn-supply unit, the yarn tension of the outer yarn 5 is increased somewhat further, so that the diameter of the yarn balloon B3 is again somewhat reduced, which similarly influences the energy consumption of the spindle drive 3 in a positive manner.

During the course of the adjustment and regulation operations for the optimisation of the yarn balloon B, a plurality of operating positions relative to the operating positions of the balloon-yarn-guide-eye 9, which are disposed between the first operating position $AP_1$ and the second operating position $AP_2$, are, of course, also obtained.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

What is claimed is:

1. A method for operating a spindle (2) of a two-for-one twisting or cabling machine, which comprises an adjustable balloon-yarn guide-eye (9), characterized in that, for the operation of the spindle (2) under production conditions, the balloon-yarn-guide-eye (9) is adjusted, on the basis of a measured value (i) which is provided by a unit which monitors energy consumption of a spindle drive (3), the measured value (i) correlating with the energy consumption of the spindle drive (3), to a first operating position ($AP_1$) in which a position-dependent minimum of the energy consumption of the spindle drive (3) is reached.

2. The method according to claim 1, characterized in that the respective first operating position ($AP_1$) of the balloon-yarn-guide-eye (9) to be approached dependent upon yarn-twisting parameters is determined in advance and can be called up for the yarn-twisting batch to be processed in order to control an adjustment drive (18) for the balloon-yarn-guide-eye (9).

3. The method according to claim 1, characterized in that the first operating position ($AP_1$) of the balloon-yarn-guide-eye (9) to be approached dependent upon yarn-twisting parameters is adjusted via a control circuit (20) and fine-tuned during the operation of the spindle (2), wherein a measured value (i) correlating with the energy consumption of the spindle drive serves as control value.

4. The method according to claim 1, characterized in that the current consumption of the spindle drive (3), the size of a yarn balloon (B) or the yarn tension of an outer yarn (5) forming the yarn balloon (B) serves as measured value (i) correlating with the energy consumption of the spindle (2).

5. The method according to claim 1, characterized in that the yarn tension of the outer yarn (5) constituting the yarn balloon (B) is increased by means of a controllable yarn-tension influencing device (22) constituted as a yarn-supply unit or yarn brake in such a manner that, for the operation of the spindle (2), the yarn balloon (B) is reduced to a size at which it still does not yet contact a protective pot (19) surrounding a feed bobbin (15).

6. The method according to claim 5, characterized in that, after the adjustment of the yarn tension by the controllable yarn-tension influencing device (22), the balloon-yarn-guide-eye (9) is moved back in the direction of the yarn course, with a further reduction of the energy consumption, to a second operating position ($AP_2$), at the overshooting of which the energy consumption of the spindle (2) rises again.

7. The method according to claim 6, characterized in that the second operating position ($AP_2$) of the balloon-yarn-guide-eye (9) is determined in advance and can be called up for the yarn-twisting batch to be processed in order to control an adjustment drive (18) for the balloon-yarn-guide-eye (9).

8. The method according to claim 6, characterized in that the balloon diameter (D2) is measured at a plane which is disposed in the region of the upper edge with the largest external diameter of the protective pot (19) as the measured value (i) correlating with the energy consumption of the spindle drive.

9. The method according to claim 6, characterized in that the balloon diameter (D2) is measured at a plane which is disposed in the region of the largest diameter of the yarn balloon B as the measured value (i) correlating with the energy consumption of the spindle drive.

* * * * *